United States Patent [19]

Groothuis

[11] Patent Number: 4,922,474

[45] Date of Patent: May 1, 1990

[54] TIMEPIECE AND METHOD FOR ITS REALIZATION

[75] Inventor: Michiel Groothuis, Saint-Imier, Switzerland

[73] Assignee: Conseilray S.A., Switzerland

[21] Appl. No.: 190,708

[22] Filed: May 6, 1988

[30] Foreign Application Priority Data

May 12, 1987 [CH] Switzerland ..... 1815/87

[51] Int. Cl.[5] ..... G04F 8/00; G04B 27/02

[52] U.S. Cl. ..... 368/113; 368/197

[58] Field of Search ..... 368/101–106, 368/107, 110, 113, 185, 196–199

[56] References Cited

U.S. PATENT DOCUMENTS

| | | | |
|---|---|---|---|
| 3,675,413 | 7/1972 | Fluck | 58/74 |
| 3,832,844 | 9/1974 | Matsumura et al. | 368/101 |
| 3,890,779 | 6/1975 | Capt et al. | 368/106 |
| 3,901,020 | 8/1975 | Capt et al. | 368/106 |
| 3,927,519 | 12/1975 | Berthoud | 368/106 |

FOREIGN PATENT DOCUMENTS

| | | |
|---|---|---|
| 850253 | 9/1939 | France . |
| 2097126 | 3/1972 | France . |
| 12518 | 12/1975 | Switzerland . |
| 647125 | 1/1985 | Switzerland . |

*Primary Examiner*—Vit W. Miska

*Attorney, Agent, or Firm*—Silverman, Cass, Singer & Winburn, Ltd.

[57] ABSTRACT

The chronograph hand (8) mounted on a shaft (7) carries a wheel (11) coaxial to a wheel (13) mounted on the end of a small-seconds shaft (2) extending beyond the frame (1) of the clockwork. A double sliding pinion (16–17), carried by a lever (14), can be brought into a position in which it meshes with the wheels (11 and 13), respectively, that renders them rigid to each other, thus ensuring the driving of the hand (8), or to be disengaged therefrom, that produces the uncoupling of this hand. The shaft (7) is maintained by a flexible bridge (9) of this mechanism which acts axially on the said shaft for pressing resiliently a resetting heart (10) it carries against the bearing (6) supporting the said shaft (7). A friction is thus produced on the shaft (7) which prevents any play of the hand (8). The wheel (11) is freely mounted on the shaft (7) it drives through the intermediary of a friction produced by a cumbered washer (12) owing to which the resetting can be effected without wheel (11) be driven.

10 Claims, 2 Drawing Sheets

TIMEPIECE AND METHOD FOR ITS REALIZATION

BACKGROUND OF THE INVENTION

1. Field of the Invention

The present invention relates to a timepiece having at least one indicating member the driving of which is able to be interrupted, and the driving mechanism of which is uncoupled to this effect.

This invention relates also to a method for the realization of this timepiece.

This invention has for purpose to permit to transform easily a conventional timepiece, comprising only the usual time indicators (hours, minutes and, may be, seconds) into a timepiece having at least one indicating member the running of which can be interrupted and re-established at will, that is the case, especially, of the chronograph-watches.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
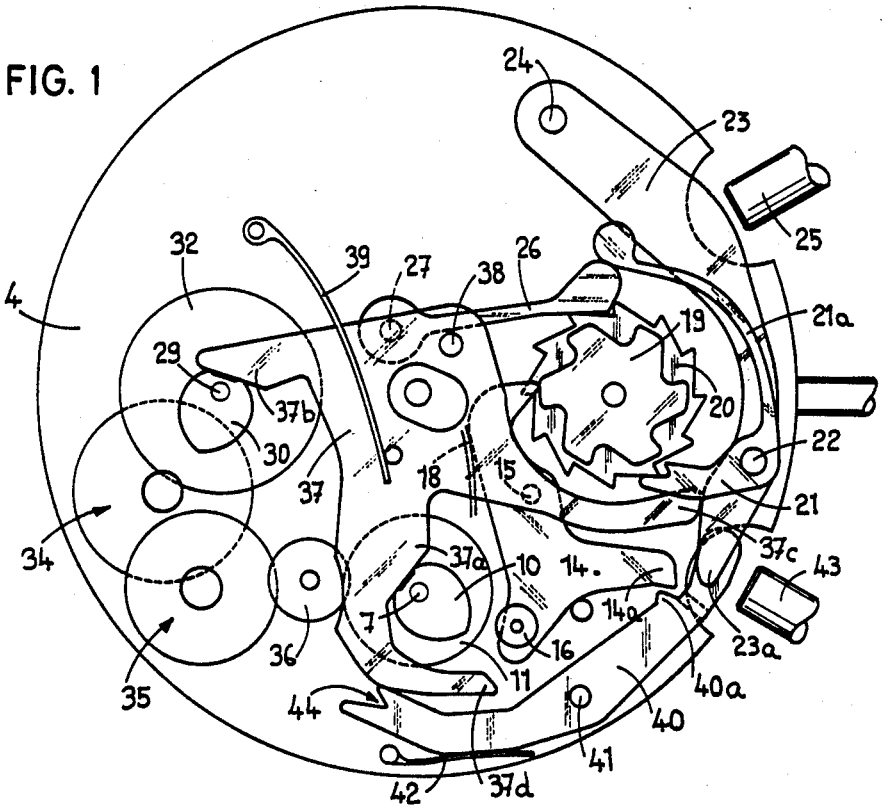
FIG. 1 is a plan view of a chronograph mechanism of a chronograph watch.

The present timepiece, the only elements of which are necessary to the understanding of the invention have been represented, comprises a conventional clockwork, the frame of which is designated by 1, this clockwork driving the conventional time indicators (hours, minutes and seconds), not represented. The gearing of this clockwork comprises a small-seconds shaft 2 (FIG. 4), making one revolution per minute, situated on the line 6–12 o'clock of the watch, which extends beyond the frame of the clockwork, and the protruding end of which carries normally a small seconds-hand which has been eliminated.

The frame 1 of the conventional clockwork carries, mounted on its face which, normally, would be provided with the watch dial, the frame, comprising two base-plates 3 and 4, of an auxiliary mechanism, of chronograph, this frame being provided with a dial 5. The base-plate 3 of this auxiliary mechanism, situated under the dial 5, carries the bearing 6 of a shaft 7, coaxial to the shaft 2, carrying a seconds or chronograph-hand 8. The shaft 7 is supported, at its opposed end, by a flexible bridge 9 secured to a not represented element of the frame of the chronograph mechanism, which exerts on the shaft 7 an axial pressure urging a resetting heart 10 carried by this shaft against the bearing 6 and, hence, tending to create on the shaft 7 a friction preventing any play of the hand 8.

The shaft 7 carries, freely mounted thereon, a driving wheel 11 which is frictionally connected to the heart 10 by a cambered washer 12 interposed between this wheel 11 and the said heart.

The protruding end of the shaft 2 of the gearing of the conventional clockwork of the watch carries, in lieu of the conventional small seconds-hand, a wheel 13, of the same number of teeth that the wheel 11 with which it is coaxial.

The chronograph mechanism comprises a lever 14, articulated at 15, which carries a double sliding pinion 16–17 the two elements of which, which are rigidly connected to each other, are situated each on one of the faces of the said lever. These two pinions, having the same number of teeth, mesh, when the lever 14 occupies its coupling position, represented in FIGS. 2 and 4, with the two wheels 11 and 13, respectively, that renders them rigid with each other and thus ensures the driving of the chronograph hand 8.

It is to be noted that the two wheels 11 and 13 could have a different number of teeth as well as the two sliding pinions 16 and 17.

The lever 14 is submitted to the action of a return spring 18 which urges it into its coupling position. It is operated by a column-wheel 19 realized as a cam having six noses, rigid with a ratchet-wheel 20 having twelve teeth. This ratchet-wheel is operated by a pawl 21 articulated at 22 on a chronograph lever 23, which is itself articulated at 24, and is operated by means of a pusher 25. The pawl 21 is prolongated by a portion 21*a* which is resiliently deformable, bearing on the head of a jumper 26, articulated at 27, ensuring the stability of the several positions of the column-wheel. Thus, the spring 21 has a triple purpose: on the one hand, it returns the pawl 21, applying it against the ratchet-wheel 20, on the other hand it returns the jumper 26, applying it also against the ratchet-wheel 20, and then it returns the chronograph lever 23 into its rest position represented in the drawing.

Figure 5:
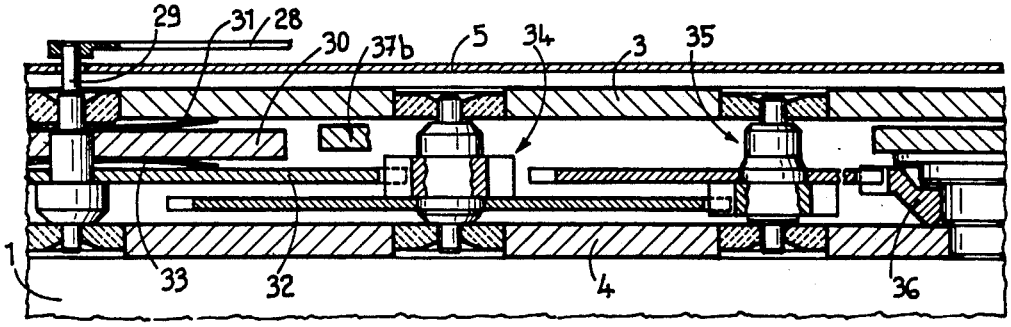
FIG. 5 is a sectional view on the line V—V of FIG. 2, to the scale of FIG. 4.

The timepiece moreover comprises a minutes indicator (minutes counter) constituted by a hand 28 (FIG. 5) mounted on a shaft 29 rotating between the base-plates 3 and 4 of the frame of the chronograph mechanism and which is rigid with a resetting hammer 30. A cambered washer 31 is interposed between the heart 30 and the base-plate 3 so as to produce on the shaft 29 a friction preventing any play of the hand 28. The shaft 29 carries a wheel 32 freely mounted thereon and which is frictionally connected with the heart 30 by a cambered washer 33 interposed between the heart and the said wheel, that permits the resetting of the hand 28 being effected without wheel 32 is driven. This wheel is driven, through the intermediary of a gearing comprising two elements 34 and 35 and an intermediate wheel 36, by the wheel 11 which drives the chronograph hand 8 and which meshes with the intermediate wheel 36.

It results from this arrangement that, when the wheel 11 is driven, the pinions 16 and 17 being meshed with wheels 11 and 13, respectively, the hand 28 is also driven.

The resetting of the two hands 8 and 28 is effected by means of a resetting lever 37 articulated at 38 provided with two peens 37*a* and 37*b* constituting two hammers cooperating with the resetting hearts 10 and 30 respectively. The resetting lever 37 is submitted to the action of a return spring 39 which urges it to rotate in the counter clockwork direction for bringing the two hammers to cooperate with the two resetting hearts. The return of the resetting lever 37 into its rest position, in which its two peens 37*a* and 37*b* are distant from the hearts 10 and 30, respectively, is effected by means of the chronograph lever 23 which is provided, to this effect, with an extension 23*a* cooperating with an arm 37*c* of the lever 37. The latter is moreover provided with a beak 37*d* which gets caught, when the lever is brought into its rest position by the chronograph lever 23, to a retaining lever 40, articulated at 41, submitted to the action of a return spring 42, and which is operable by means of a resetting pusher 43. This lever is provided, at its end, with a notch 44 (FIG. 1) into which gets caught the beak 37*d* of the resetting lever 37.

Figure 2:
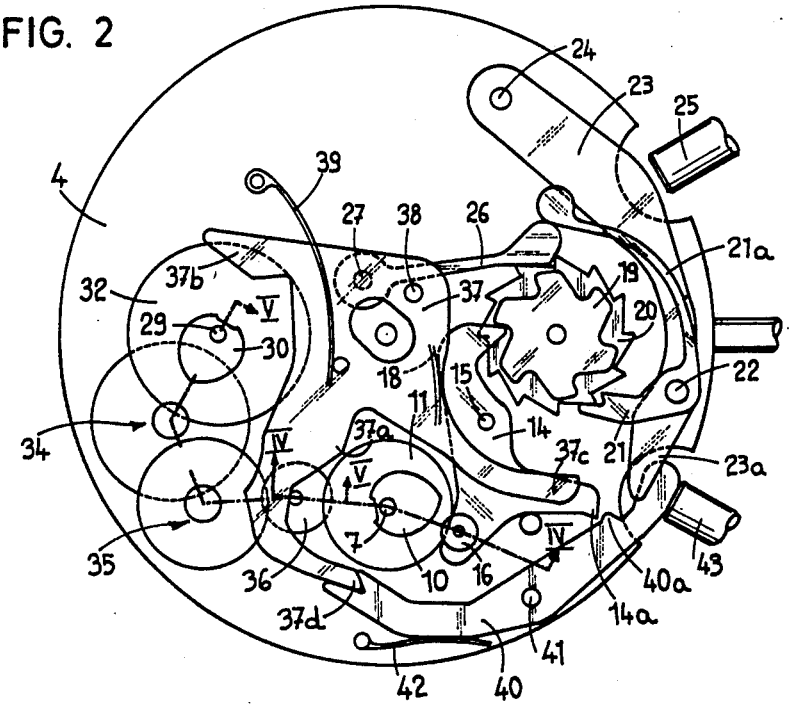
FIGS. 2 and 3 are similar views, to a smaller scale, of this mechanism represented in two other working positions.

This chronograph operates as follows: when the mechanism occupies its stopping position, the hands 8 and 28 being reset to zero and being held in this position by the two hammers 37*a* and 37*b*, respectively, that is the position represented in FIG. 1, a pressure exerted on the pusher 25 brings the column-wheel 19 into the position represented in FIG. 2 in which, under the action of its return spring 18, the lever 14 has rotated in the clockwork direction, bringing the double slide pinion 16–17 it carries to mesh with the two coaxial wheels 11 and 13, respectively, that produces the driving of the hands 8 and 28.

Simultaneously, the end portion 23*a* of the lever 23 acting on the arm 37*c* of the resetting lever 37 has made the latter to rotate in the clockwork direction, against the action of its return spring 39, releasing the two hearts 10 and 30. At the end of the stroke of the lever 37, its beak 37*d* has engaged the notch 44 of the lever 40, while lifting this lever slightly against the action of its return spring 42. Hence, in this position (FIG. 2), the hands 8 and 28 are driven and the hammers 37*a* and 37*b* are maintained distant from the resetting hearts.

It is to be noted that, if in this position of the mechanism a pressure is exerted on the resetting pusher 43, this wrong operation will have no effect since, then, a nose 40*a* of the retaining lever 40 abuts against an arm 14*a* of the lever 14, that prevents it from moving up to the releasing of the resetting lever 37.

Figure 3:
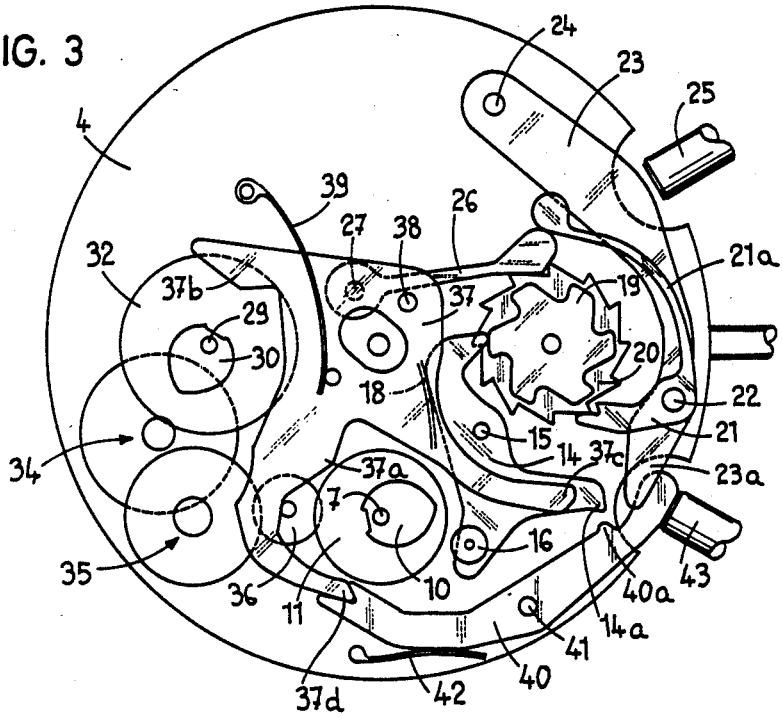

The chronograph being in operation, a pressure exerted on the pusher 25 produces the displacement of one step of the column-wheel 19, that lifts the lever 14, thus disengaging the double sliding pinion 16–17 carried by this lever from the wheels 11 and 13, thus discoupling the chronograph (FIG. 3).

From this position of the mechanism, the user of the timepiece can either make the chronograph running again or reset the hands 8 and 28. Thus, the chronograph is of the type called as a "three functions chronograph". In the first case, it acts on the pusher 25, bringing the mechanism into the position of FIG. 2, while, in the second case, it acts on the pusher 43, moving the retaining lever 40, the displacements of which are no more prevented by the arm 14*a* of the lever 14, that releases the beak 37*d* of the resetting lever 37 which, under the action of its return spring 39, rotates in the counter clockwork direction, acting on the two hearts 10 and 30, thus resetting the hands 8 and 28.

As a modification, the shaft 7 carrying the chronograph hand 8 could be hollow and the shaft 2 of the basis clockwork, carrying the wheel 13, could be prolongated through this hollow shaft and carry a "trotteuse" seconds-hand rotating above the hand 8.

Figure 4:
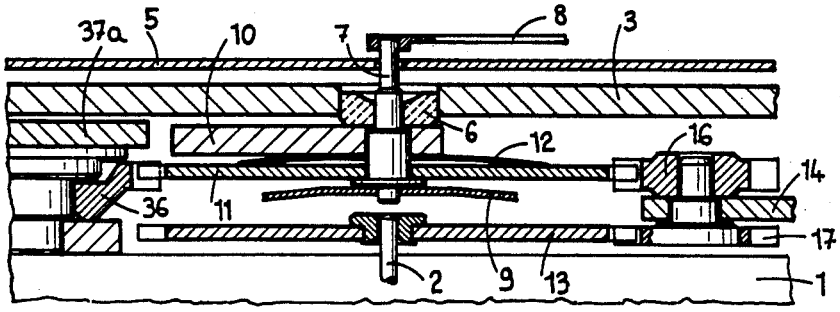
FIG. 4 is a sectional view on the line IV—IV of FIG. 2, to a larger scale.

It is to be noted, while referring specially to FIG. 4, that the present invention permits to transform easily a conventional watch, such as the watch the clockwork of which has been designated by 1, which comprises only conventional time indicators (hours, minutes and, may be, seconds) into a chronograph watch, that is to say a watch comprising indicators the running of which can be interrupted and re-established at will.

To this effect, one will eliminate the conventional dial of the watch 1 and one will place on the clockwork of this watch, at the place of the dial, the frame of the auxiliary mechanism comprising the two base-plates 3 and 4. In the case where the shaft 2 of the gearing of the clockwork 1 carries, initially, a hand, for instance a small seconds-hand situated out from the center of the watch, one will eliminate this hand and replace it by the wheel 13. Obviously, the conventional elements of the watch carrying the hours, minutes and seconds hands, in the center, must be prolongated so as to extend beyond the dial 5 carried by the auxiliary mechanism. If the shaft of the gearing of the clockwork 1 used as power point for driving the supplementary indicating members, which can be coupled and uncoupled, does not carry any hand, it must also be prolongated so as to extend beyond the frame of the clockwork 1 for permitting the wheel 13 to be situated, in height, in the thickness of the auxiliary mechanism.

I claim:

1. A timepiece having at least one indicating member the driving of which is able to be interrupted by uncoupling a driving mechanism thereof, comprising a base clockwork driving at least one time indicator mounted on a shaft on a base frame to which is secured a frame of an auxiliary mechanism carrying the indicating member, said indicating member including a shaft coaxial with said base clockwork shaft, said base clockwork shaft carrying, situated on the side of the auxiliary mechanism, a base clock-work drive wheel which is coaxial with a drive wheel carried by said indicating member shaft, a driving mechanism of said indicating member including a double sliding pinion able to occupy two positions, a coupling position meshing with both said two coaxial drive wheels to connect said drive wheels together, said base clockwork drive wheel driving said indicating drive wheel member, and a second uncoupling position not meshing with said wheels so that said indicating member drive wheel is not driven to drive said indicating member.

2. Timepiece as claimed in claim 1, in which said base clockwork shaft extends beyond said base frame, locating said base clockwork drive wheel adjacent said auxiliary mechanism.

3. Timepiece as claimed in claim 1, in which said double sliding pinion includes two distinct pinions situated each on opposite faces of a first lever supporting said pinions to control the movements thereof.

4. Timepiece as claimed in claim 3, in which said lever is controlled by a column-wheel rigid with a ratchet-wheel, said ratchet-wheel operated by a second lever through the inter-mediary of a pawl articulated thereon and including a resiliently deformable portion bearing on a jumper to position said column-wheel and operating as a return spring at the same time for said pawl, for said jumper and the said second lever carrying said pawl.

5. Timepiece as claimed in claim 1, in which said indicating member is rigid with a resetting heart, including a friction connection between said heart and said indicating drive wheel to permit the resetting of said indicating member without driving said indicating drive wheel.

6. Timepiece as claimed in claim 5, including a resetting hammer cooperating with said heart mounted rigid with said indicating member under the action of a return spring urging said indicating member against said heart, said hammer provided with a beak for catching a retaining lever, said retaining lever in a rest position maintaining said hammer separated from said resetting heart against the action of said hammer return spring and which, when said retaining lever is operated, releases said hammer for permitting said hammer to effect a resetting operation.

7. Timepiece as claimed in claim 6, in which said first lever and said retaining lever are arranged in such a way that, when said first lever occupies said coupling position, said first lever bears on a portion of said retaining lever to retain said hammer and prevent the operation of said retaining lever and, consequently, preventing the resetting operation.

8. Timepiece as claimed in claim 6, in which said second lever operating said column-wheel is arranged to act, when it operates the column-wheel for bringing said first sliding pinion lever from the uncoupling position to the coupling position, on said resetting hammer so as to lift said hammer against the action of a return spring and removing said hammer from said resetting heart.

9. Timepiece as claimed in claim 1, in which said indicating member and said indicating member driving wheel are both carried by said indicating member shaft mounted between a rigid bridge of said auxiliary mechanism frame and an elastic bridge acting axially on said indicating member shaft for applying a shoulder against a bearing element, creating friction on said indicating member shaft preventing any play of said indicating member therewith.

10. Timepiece as claimed in claim 1, which said indicating member driving wheel meshes with a pinion including a first gearing element of a gearing mechanism driving a second indicating member, the driving of which is able to be interrupted, said second indicating member rigid with a resetting heart, a last gearing element of said gearing mechanism being connected to said resetting heart by a friction coupling permitting the resetting of said second indicating member to be effected without driving said gearing mechanism.

* * * * *